United States Patent [19]

Croyle

[11] 4,326,709

[45] Apr. 27, 1982

[54] FISHING FOR CARDS GAME

[76] Inventor: Ronald A. Croyle, R.D. #1 Helm Rd., Adrian, Pa. 16210

[21] Appl. No.: 101,777

[22] Filed: Dec. 10, 1979

[51] Int. Cl.[3] ..... A63F 9/00

[52] U.S. Cl. ..... 273/1 GC; 273/1 GD; 273/1 GG; 273/140; 273/295

[58] Field of Search ..... 273/1 R, 1 E, 1 M, 140, 273/295, 139, 1 GC, 1 GD, 1 GG

[56] References Cited

U.S. PATENT DOCUMENTS

| | | | |
|---|---|---|---|
| 1,257,045 | 2/1918 | Stotler | 273/1 M |
| 1,509,873 | 9/1924 | Ordway | 273/140 X |
| 2,600,951 | 6/1952 | Edwards | 273/295 |
| 2,747,872 | 5/1956 | Harvey | 273/1 M |
| 3,433,478 | 3/1969 | Span et al. | 273/1 M |
| 3,545,750 | 12/1970 | Stachnik, Sr. | 273/140 X |
| 3,627,316 | 12/1971 | Machinski | 273/1 M |
| 3,788,641 | 1/1974 | Lemelson | 273/140 X |

OTHER PUBLICATIONS

Playthings Magazine, vol. 56, No. 8, p. 26, 8-1958.

*Primary Examiner*—Paul E. Shapiro
*Attorney, Agent, or Firm*—Harold A. Williamson

[57] ABSTRACT

This invention relates to a fishing for cards game of skill which includes in combination a game board housing having a field of play upper surface member and a lower support surface member parallel to the upper surface. First side members are integrally secured to the upper surface member and disposed in a direction toward the lower surface. Second side members are integrally secured to the lower support surface and are disposed in a direction toward the upper surface. The upper surface with the first side members and the lower surface with the second side members cooperate to form a flat box shaped compartment. A spacing sheet having a roughened textured surface is disposed between the upper surface the lower surface and is in contact with the lower surface only. The field of play upper surface has an opening centrally located in the field of play. The opening communicating with an open region between the upper surface member and the roughened textured surface of the spacer sheet.

Playing cards are disposed within the open region and on the roughened textured surface. Each of the playing cards has a magnetizable element secured thereto. A permanent magnet fishing means is cooperatively positioned on the planer field of play whereby movement of the permanent magnet fishing means along the field of play results in the attraction of the magnetizable elements of the playing cards whereupon the playing cards may be drawn to the centrally located opening and withdrawn.

6 Claims, 6 Drawing Figures

FISHING FOR CARDS GAME

Figure 1:
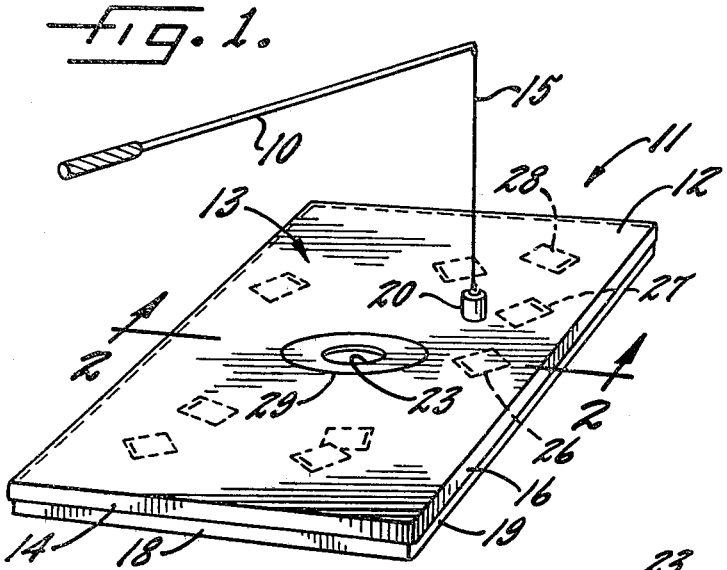

This invention relates to a fishing for cards game of skill.

More specifically, this invention relates to a fishing for cards game of skill which includes in combination a game board housing having a field of play upper surface member and a lower support surface member parallel to the upper surface. First side members are integrally secured to the upper surface member and disposed in a direction toward the lower surface. Second side members are integrally secured to the lower support surface and are disposed in a direction toward the upper surface. The upper surface with the first side members and the lower surface with the second side members cooperate to form a flat box shaped compartment. A spacing means having a roughened textured surface is disposed between the upper surface the lower surface and is in contact with the lower surface only. The field of play upper surface has an opening centrally located in the field of play. The opening communicating with an open region between the upper surface member and the roughened textured surface of the spacer means.

Playing cards are disposed within the open region and on the roughened textured surface. Each of the playing cards has a magnetizable element secured thereto. A permanent magnet fishing means is cooperatively positioned on the planar field of play whereby movement of the permanent magnet fishing means along the field of play results in the attraction of the magnetizable elements of the playing cards whereupon the playing cards may be drawn to the centrally located opening and withdrawn.

Games of skill involving the use of magnetic objects suspended by a flexible cord above a playing board have been many and varied over the years. Typical of such games is that shown in the Hoetzel US. Pat. No. 3,864,872 which is directed to a fishing pole and line retrieving mechanism which line has a magnet attached to one end for catching toy fish. Another such fishing game is shown in the Baker U.S. Pat. No. 3,836,142 in which magnets are located in a playing board and game pieces have to be caught with a fishing rod and magnetizable hook and successfully drawn past the magnets with a game piece secured to the hook.

Heretofore, no one has devised a game that would allow an individual to play cards by blindly locating and then drawing the cards to player for use in a card game of their choosing. The fishing for cards game to be described more fully hereinafter creates just such a game. The game requires that the player be able to physically sense the presence of a randomly located and then captured card. Once the player has caught card or cards which he cannot see, he must with significant deftness and skill draw the card to a place where the cards may be withdrawn and thereafter be involved in any of a number of conventional or unique card games.

It is therefore a primary object of this invention to provide a fishing for cards game of skill in which hidden playing cards having magnetizable regions are located and drawn into an access region for subsequent play.

Another object of the invention is to provide a fishing for cards game of skill which involves the use of a permanent magnet drawn across of field of play which game includes in combination a means to indicate that the magnet has been lifted from the playing field.

Yet another object of the invention is to include in combination with the fishing for cards game a means to preset the time allowed each player to fish for hidden cards and give an indication that the time has elapsed or the magnet has been lifted from field of play.

In the attainment of the foregoing objects the invention includes in combination a game board housing having a planer field of play upper surface member and a lower planer support surface member parallel to the upper surface. First side members are integrally secured to the upper surface member and are disposed in a direction toward the lower surface. Second side members are integrally secured to the lower support surface and disposed in a direction toward the upper surface. The upper surface with the first side members and the lower surface with the second side members cooperate to form a flat box shaped compartment. Located with this box shaped compartment is a spacer means that has a roughened textured surface on at least one side. The spacer fits within the box shaped compartment and rests on the lower surface member leaving a space or open region between the roughened textured surface and the upper surface member. The field of play has an opening centrally located in the field of play. The opening communicating with the open region above the roughened textured surface. Playing cards are disposed within the open region and rest on the roughened textured surface, each of the playing cards having a magnetizable element secured thereto.

A permanent magnet fishing means is cooperatively positioned on the field of play whereby movement of the permanent magent fishing means along the play field results in the attraction of the magnetizable elements of the playing cards whereupon the playing cards may be drawn to the centrally disposed opening, withdrawn and thereafter employed in a card game of the players choice.

In one of the invention's embodiments the field of play of the upper planer surface is formed of an electrically conductable material and a source of power is connected to the permanent magnet fishing means and to the electrically conductive material, as well as an indication means to thereby form a complete playing surface contact detection circuit. This circuit provides an indication via the indication means so long as the permanent magnet fishing means is in contact with the electrically conductive material of the field of play.

In another embodiment of the invention the playing surface contact detection circuit includes a timing means which is electrically coupled to the detection circuit to provide for an interruption of the detection circuit after a preselected playing time has elapsed.

In yet another embodiment of the invention the permanent magnet fishing means is connected by an electrical lead to a manually movable fishing rod. The electrical lead having one end electrically connected to the permanent magnet and its other end electrically connected to the source of power.

Figure 3:
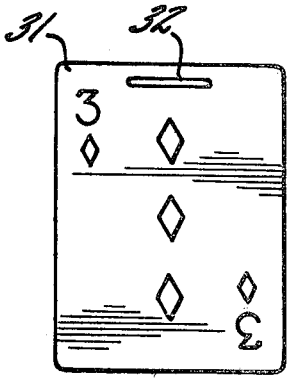
Figure 2:
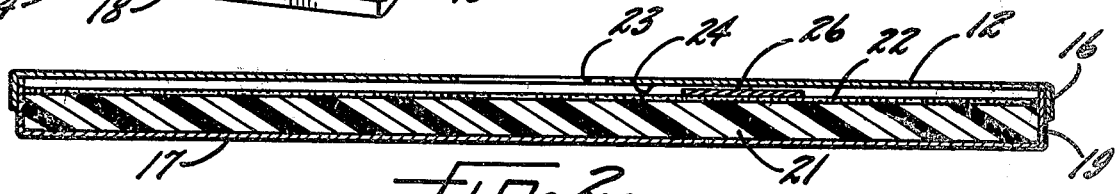
Figure 6:
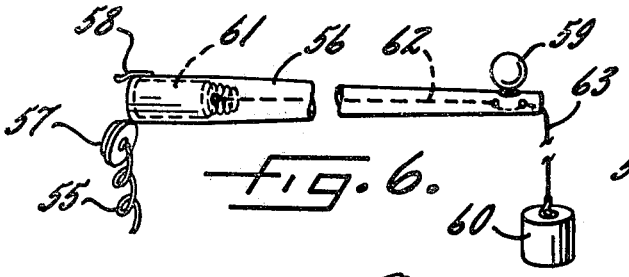
Figure 5:
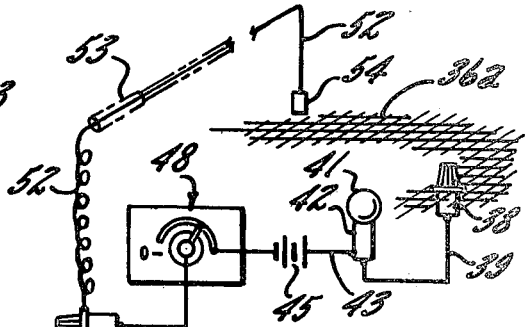
Figure 4:
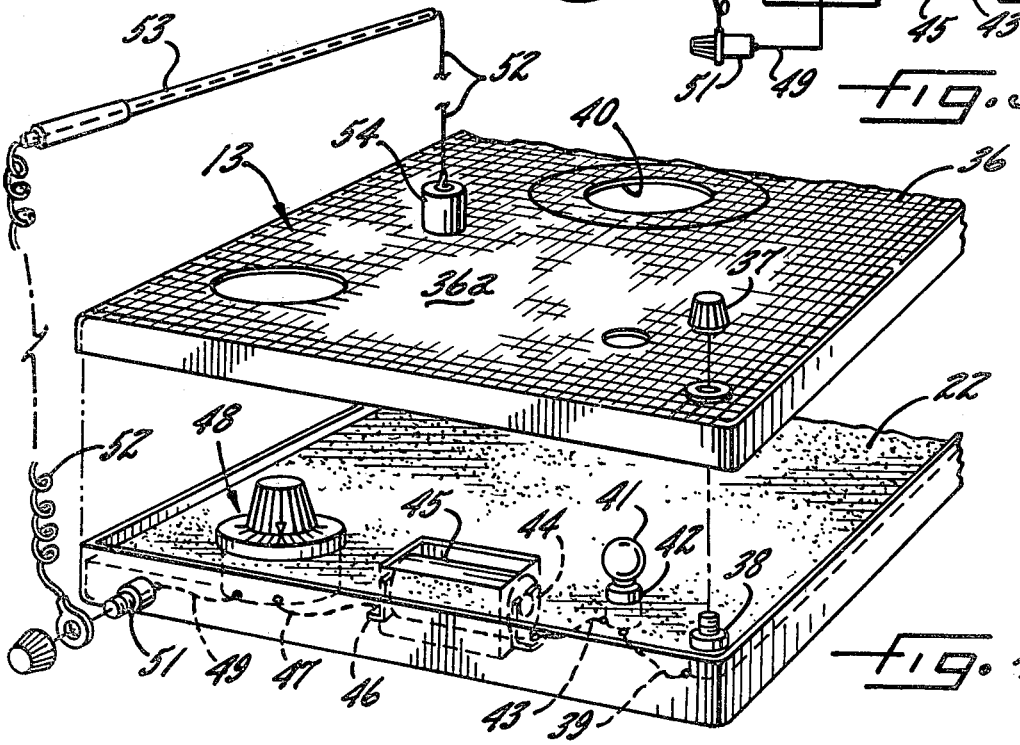

Other objects and advantages of the present invention will become apparent from the ensuing description and the illustrative embodiments thereof, in the course of which reference is made to the accompanying drawings in which:

FIG. 1 is a three dimensional showing of the preferred embodiment of the invention, and FIG. 2 is a cross-section taken along the line 2—2 of FIG. 1, and FIG. 3 is a playing card with a magnetizable element secured thereto, and FIG. 4 is another embodiment of the invention which includes a playing surface detection circuit and timer, and FIG. 5 is a simplified wiring diagram of the electrical circuit of FIG. 4, and FIG. 6 is a fishing rod with a light bulb indication means secured thereto.

Reference is now made to FIG. 1 in which there is illustrated in a three dimensional form the preferred embodiment of the invention. A flat shaped box 11 is depicted which has an upper surface member 12 with a field of play 13. The upper surface member 12 has first side members 14, 16, two of which are shown, integrally secured thereto. FIG. 2 should be studied in conjunction with FIG. 1. In FIG. 2 it can be seen that there is a lower support surface member 17 which has upwardly directed second side members 18, 19 which fit within the first side members to form the flat shaped box 11. In FIG. 2 there is shown a spacer means 21 which can be fashioned of any light weight foam plastic material. The spacer means has on its upper surface a roughened surface textured material 22. The thickness of the spacer means 21 and roughened surface textured material is such that there remains a space or open region 24 below and between the upper surface member 12 and the spacer means and textured material 22. Centrally located within the field of play 13 is an opening 23 which passes through the upper surface member 12.

Shown in dotted outline in FIG. 1 are a number of playing cards, of which card 26, 27 and 28 are referenced.

FIG. 3 shows a typical playing card 31 which has a magnetizable staple 32 secured to the card 31. A circle 29 has been enscribed on the field of play 13. The function of the circle 29 will be explained hereinafter in respect of the manner in which the fishing for cards game may be played. The thickness of the playing cards is such that when the staple each includes is attracted by a magnet they may be moved along the roughened textured surface material 22. A permanent magnet 20 shown attached by line 15 to fishing pole 10 provides the magnet which is used to attract or fish for the playing cards.

FIG. 4 depicts in partial section another embodiment of the invention in which the field of play has been formed of an electrically conductive screen material 36. Only two portions of the screen material 36 and **36*a* have been shown. It is to be understood of course that the entire field of play 13 on the upper surface member 12 is covered by the electrically conductive screen. An opening 40 similar to opening 23 in FIG. 1 is provided. The openings 23 and 40** are the regions through which the playing cards are eventually withdrawn.

In the embodiment of FIG. 4 there is presented a circuit which includes the screen 36, terminal connector 37 on terminal post 38, lead 39, a light or indication means 41 on light support post 42, lead 43, battery terminal 44, battery 45, battery terminal 46, lead 47, timer 48, lead 49, terminal connector 51, lead 52, through a fishing rod 53 to permanent magnet 54. The battery 45 is visable due to a portion of the spacer means 22 having been removed for purposes of illustration.

In FIG. 5 all the circuit details of FIG. 4 are set forth in a schematic manner. It should be obvious that an electrical circuit is completed such that the light or indication means 41 remains illuminated as long as the permanent magnet 54 remains in contact with electrically conductive screen 36 as shown at **36*a***.

The timer 48 is designed such that it can be set for different periods of time. Upon elapse of the set time the circuit described is interrupted and the light 41 goes out.

FIG. 6 shows an embodiment of the invention in which a light 61 is included on the fishing pole 56. The fishing pole 56 is hollow and has a battery 61 positioned in fishing pole handle. A closeable cap 57 and latch 58 act to retain the battery 61 in place. An electrical lead 55 is connected to the game board box as was lead 52 in FIG. 4. An electrical lead 62 connects the battery 61 to the light 59 and a lead 63 connects the light 59 to the permanent magnet 60. The arrangement just described can be used in with circuit arrangement of FIG. 4 and FIG. 5 with the battery and light moved in the series circuit to the position shown in FIG. 6.

HOW THE GAME IS PLAYED

One manner in which the game can be played will be described in conjunction with the preferred embodiment of FIG. 1.

A player will move the magnet 20 over the field of play 13 until they feel contact through the upper surface member 12 has been made with a magnetizable portion of a card such as cards 26, 27, etc. The player will then draw the magnet carefully towards the opening 23 and pull up the cards. If the player moves too rapidly he may loose the cards he has initially caught. The more cards the player is able to retrieve the better off he will be in whatever card game in which he intends to use the cards. A player gets to keep all the cards pulled out and if any of the cards fall off and are resting partly on top of the game board or the edge of the hole 23 the player may try to remake magnetic contact with the now exposed cards, providing of course that it can be done without lowering the magnet 20 in the hole 23. These cards just noted must be retrieved without touching any portion of the field of play 13. If the player makes a mistake he must stop his play and draw the magnet up with the card or cards attached and then remove the cards and place them face down and out of play. Before trying to remake contact a player may take off any cards attached to the magnet.

A circle 29 is shown on the field of play 13. In one of the many manners in which the game may be played when the player enters the circle, the player is not permitted to go back out into the field of play to fish for additional cards. Each player has only a single opportunity during his turn to fish to lift the magnet upwardly to finally retrieve the cards caught while fishing for cards. Any upward movement that causes the magnet 20 to leave the field of play ends the players turn. Any cards retrieved during an inadvertent movement of the magnet are taken out of play. The player may fish within the hole 23 but not touch the edges of the hole. Touching of the edge of the hole 23 ends a player's turn.

In order to remove any controversy in respect of whether the player has caused the magnet to loose contact with the field of play the embodiments of the invention shown in FIGS. 4, 5 and 6 may be employed. These embodiments provide a circuit which is interrupted when the magnet is lifted from the field of play, or should the player be in the hole intentionally fishing for a card therein, should he touch the side of hole the circuit would be completed and an indication given of the touching.

There are as many card games possible as the imagination of the players can conceive, thereby affording unlimited enjoyment without the possibility of boredom.

For example, the players may simply count points giving face cards values. The players may set time limits on the length of time they are each allowed to fish as is readily possible with the embodiments of the invention as shown in FIGS. 4, 5 and 6.

The beauty of the invention lies in the fact that if the players agree they can create limitless opportunities for entertainment with the invention herein described.

Although this invention has been illustrated and described in connection with particular embodiments thereof, it will be apparent to those skilled in the art that various changes may be made without departing from the spirit of the invention.

What is claimed as new:

1. A fishing for cards game of skill including in combination a game board housing having a planer field of play upper surface member and a lower planer support surface member parallel to said upper surface, said field of play of said upper planer surface being formed of an electrically conductible material, first side members integrally secured to said upper surface member and disposed in a direction toward said lower surface, second side members integrally secured to said lower support surface and disposed in a direction toward said upper surface, said upper surface with said first side members and said lower surface with said second side members cooperating to form a flat box shaped compartment, spacer means having a roughened textured surface disposed between said upper surface and said lower surface and in contact with said lower surface, said planer field of play upper surface having an opening centrally disposed in said field of play, said opening communicating with an open region between said upper surface member and said roughened textured surface of said spacer means, playing cards disposed within said open region and on said roughened textured surface, each of said playing cards having a magnetizable element secured thereto, permanent magnet fishing means cooperatively positioned on said planer field of play whereby movement of said permanent magnet fishing means along said planer field of play results in the attraction of said magnetizable elements of said playing cards whereupon said playing cards may be drawn to said centrally disposed opening and withdrawn, a source of power is connected to said permanent magnet fishing means and to said electrically conductive material, as well as an indication means to thereby form a complete playing surface contact detection circuit which provides an indication via said indication means so long as said permanent magnet fishing means is in contact with said electrically conductive material of said field of play.

2. The fishing for cards game of claim 1 wherein said playing surface contact detection circuit includes a timing means which is electrically coupled to said detection circuit to provide for an interruption of said detection circuit after a preselected playing time has elapsed.

3. The fishing for cards game of claim 2 wherein said permanent magnet fishing means is connected by an electrical lead to a manually movable fishing rod, said electrical lead having one end electrically connected to said permanent magnet and its other end electrically connected to said source of power.

4. The fishing for cards game of claim 2 wherein said indication means is a light bulb.

5. The fishing for cards game of claim 3 wherein said light bulb is electrically coupled to said electrical lead and in series with and between said permanent magnet and said source of power.

6. The fishing for cards game of claim 3 wherein said light bulb is secured to said fishing rod.

* * * * *